US011686016B2

(12) United States Patent
Abu-Rous et al.

(10) Patent No.: US 11,686,016 B2
(45) Date of Patent: Jun. 27, 2023

(54) LYOCELL FILAMENT LINING FABRIC

(71) Applicant: LENZING AG, Lenzing (AT)

(72) Inventors: Mohammad Abu-Rous, Vienna (AT); Susanne Carls, Lenzing (AT); Dieter Eichinger, Fürstenfeld (AT); Martin Neunteufel, Hong Kong (CN); Christoph Schrempf, Bad Schallerbach (AT)

(73) Assignee: LENZING AKTIENGESELLSCHAFT, Lenzing (AT)

( * ) Notice: Subject to any disclaimer, the term of this patent is extended or adjusted under 35 U.S.C. 154(b) by 357 days.

(21) Appl. No.: 16/652,760

(22) PCT Filed: Sep. 19, 2018

(86) PCT No.: PCT/EP2018/075341
§ 371 (c)(1),
(2) Date: Apr. 1, 2020

(87) PCT Pub. No.: WO2019/068468
PCT Pub. Date: Apr. 11, 2019

(65) Prior Publication Data

US 2020/0232123 A1 Jul. 23, 2020

(30) Foreign Application Priority Data

Oct. 6, 2017 (EP) ..... 17195260

(51) Int. Cl.
*D03D 15/00* (2021.01)
*D01F 2/00* (2006.01)
(Continued)

(52) U.S. Cl.
CPC ..... *D01F 2/00* (2013.01); *A41D 27/02* (2013.01); *D02G 3/02* (2013.01); *D03D 15/225* (2021.01);
(Continued)

(58) Field of Classification Search
CPC .. D01F 2/00; A41D 27/02; A41D 1/02; A41D 2500/20; D02G 3/02; D03D 15/225;
(Continued)

(56) References Cited

U.S. PATENT DOCUMENTS 4,246,221 A * 1/1981 McCorsley, III ..... D01F 2/00 264/210.8
6,013,367 A * 1/2000 Nakagawa ..... D06M 11/38 8/194
(Continued)

FOREIGN PATENT DOCUMENTS

AU 2018344310 B2 12/2020
CN 104287127 A 1/2015
(Continued)

OTHER PUBLICATIONS

International Search Report issued in International Patent Application No. PCT/EP2018/075341 dated Jul. 11, 2018, (4 pages).
(Continued)

*Primary Examiner* — Robert H Muromoto, Jr.
(74) *Attorney, Agent, or Firm* — Venable LLP

(57) ABSTRACT

A lining fabric (3) for a clothing article (1). The lining fabric (3) is hygroscopic to ensure good wearing comfort, and has sufficient dimensional stability to allow washing in a household laundry machine. The lining fabric (3) is made from yarns (6) containing or consisting of Lyocell filaments (7). The Lyocell filaments (7) have an average linear density of less than 1.5 dtex, preferably less than 1.4 dtex and even more preferred, less than 1.3 dtex. The washing shrinkage
(Continued)

after five washings is preferably less than 4% in each of two perpendicular directions.

15 Claims, 1 Drawing Sheet

(51) Int. Cl.
*A41D 27/02* (2006.01)
*D02G 3/02* (2006.01)
*D03D 15/225* (2021.01)
*D03D 15/573* (2021.01)
*A41D 1/02* (2006.01)

(52) U.S. Cl.
CPC ..... *D03D 15/573* (2021.01); *A41D 1/02* (2013.01); *A41D 2500/20* (2013.01); *D10B 2201/22* (2013.01); *D10B 2501/00* (2013.01)

(58) Field of Classification Search
CPC ..... D03D 15/573; D10B 2201/22; D10B 2501/00; D06P 3/66
See application file for complete search history.

(56) References Cited

U.S. PATENT DOCUMENTS

| | | | | |
|---|---|---|---|---|
| 6,930,179 | B2 | 8/2005 | Schmiedl et al. | |
| 7,579,078 | B2 | 8/2009 | Hartmann et al. | |
| 10,883,196 | B2 * | 1/2021 | Schrempf | D01F 2/00 |
| 2001/0054209 | A1 * | 12/2001 | Collins | D06P 5/08 8/918 |
| 2003/0097721 | A1 * | 5/2003 | Schmiedl | C09B 62/4413 8/445 |
| 2004/0211013 | A1 | 10/2004 | Schmiedl et al. | |
| 2005/0245164 | A1 * | 11/2005 | Aneja | D04H 1/54 428/920 |
| 2007/0026228 | A1 * | 2/2007 | Hartmann | D01F 1/08 442/361 |
| 2011/0238025 | A1 * | 9/2011 | Law | A61L 15/28 604/374 |
| 2012/0156486 | A1 * | 6/2012 | Bisjak | D01F 2/08 428/375 |
| 2015/0086758 | A1 * | 3/2015 | Tutterow | D03D 9/00 428/196 |
| 2015/0159302 | A1 * | 6/2015 | Leitner | D01F 2/06 428/221 |

FOREIGN PATENT DOCUMENTS

| | | | | |
|---|---|---|---|---|
| EP | 1122346 | B1 * | 5/2004 | A61F 13/0273 |
| JP | S54-140641 | A | 11/1979 | |
| JP | H09-143836 | A | 6/1997 | |
| JP | H10-18145 | A | 1/1998 | |
| JP | H10-72740 | A | 3/1998 | |
| JP | H10-131038 | A | 5/1998 | |
| JP | H11-335935 | A | 12/1999 | |
| JP | 2001-512536 | A | 8/2001 | |
| JP | 2006-176916 | A | 7/2006 | |
| JP | 2006176916 | A | 7/2006 | |
| JP | 2009-544866 | A | 12/2009 | |
| JP | 2011-509356 | A | 3/2011 | |
| RU | 2291925 | C2 | 1/2007 | |
| SU | 98111 | A1 | 11/1953 | |
| WO | 02/18682 | A1 | 3/2002 | |
| WO | 02/072929 | A1 | 9/2002 | |

OTHER PUBLICATIONS

Search report issued in an Office Action for Japanese Application No. 2020-519757 dated Jun. 11, 2021.
Brazilian Office Action dated Jul. 5, 2022 issued in corresponding BR112020004678-7 (6 pages).
"Ring Spinning, the widely used yarn formation technique" (Textile School, Jul. 11, 2018; https://www.textileschool.com/317/ring-spinning-the-widely-used-yarn-formation-technique/).
BISFA (The International Bureau for the Standardization of Man-Made Fibers) publication, "Terminology of Man-Made Fibers", 2009 edition.

* cited by examiner

LYOCELL FILAMENT LINING FABRIC

The present application is a national-stage entry under 35 U.S.C. § 371 of International Patent Application No. PCT/EP2018/075341, published as WO 2019/068468 A1, filed Sep. 19, 2018, which claims priority to EP 17195260.9, filed Oct. 6, 2017, the entire disclosure of each of which is hereby incorporated by reference.

BACKGROUND OF THE INVENTION

Field of the Invention

The invention relates to lining fabrics and to clothes and clothing articles having a lining comprising or consisting of a lining fabric.

Lining fabrics are used primarily in outerwear and form the layer of the clothing article which faces the wearer. To allow for easy dressing and undressing, lining fabrics have a smooth surface so that there is as little friction as possible between the lining fabric and the underlying layer of clothes or the body of the wearer.

In the prior art, natural filaments such as silk filaments or viscose, cupro or acetate filaments are used for lining fabrics. These types of filaments provide a smooth surface for the lining fabric. Further, they exhibit sufficient moisture absorption to increase comfort. Silk, viscose, cupro or acetate filaments are, however, problematic in that a fabric made from these filaments is not dimensionally stable if washed using a regular laundry machine as it is available in a household. Lining fabric made of these filaments exhibits considerable shrinkage even after one washing. Therefore, clothing articles having a fabric lining made of these filaments need to be dry-cleaned. This is burdensome to the consumer.

Dimensional stability is maintained by a lining fabric which is made of filaments of synthetic polymers such as polyamide or polyester. However, these polymers have only very small moisture absorption, and thus are not comfortable to wear.

In view of the above problems, it is the object of the invention to provide a fabric lining which satisfies high quality standards with regard to at least one of smoothness and softness and which exhibits sufficient dimensional stability to be washed in a regular household laundry machine. At the same time, wearing comfort should be high.

This problem is solved according to the invention by a lining fabric having at least one layer containing or consisting of yarn, the yarn containing or consisting of Lyocell filaments, the Lyocell filaments having, in the conditioned state, an average linear density between 0.6 and 4 dtex.

Yarn made from such fine Lyocell filaments results in a lining fabric which is hygroscopic and thus provides good comfort. Surprisingly, it has been shown that by using such fine Lyocell filaments, the lining fabric is dimensionally stable even if it is washed several times in a regular household laundry machine.

Using Lyocell filaments provides the additional advantage over other man-made cellulose filaments and over synthetic polymers that the manufacturing process is environmentally friendly as the cellulose solvent is recirculated within the process.

The method for manufacturing Lyocell filaments is explained in U.S. Pat. No. 4,246,221 and in the BISFA (The International Bureau for the Standardization of Man-Made Fibers) publication "*Terminology of Man-Made Fibres*", 2009 edition. Both references are included herewith in their entirety by reference. Further, the terminology used in this specification and in the claims is as defined in the BISFA publication.

Reference is also made to WO 02/18682 A1 and WO 02/72929 A1, which relate to a method for producing cellulose filament yarns, and are also included in their entirety.

The lining fabric according to the invention may, according to one embodiment, have a washing shrinkage after five washings of less than 3.5% in at least one, preferably both of two perpendicular directions. The shrinkage after one washing may be not more than 2% in at least one of the two, preferably both perpendicular directions. Shrinkages are preferably determined in the conditioned state of the sample of the lining fabric.

Preferably, the lining fabric is woven and the two perpendicular directions are aligned with the direction of the weft and the warp respectively. The washing shrinkage may further be determined using a sample which is prepared according to EN ISO 3759. This standard is included in its entirety by reference. Further, the washings may conform to the standard EN ISO 6330. This standard is also included in its entirety be reference.

A combined washing shrinkage after five washings, which is obtained by adding the absolute values of washing shrinkages of the sample in the perpendicular directions, may be not more than 10%, in particular not more than 7%. Moreover, a combined washing shrinkage after one washing of not more than 3%, preferably of not more than 2%, can be obtained with the lining fabric according to the invention.

If the fabric lining consists of more than one layer, the yarn consisting of or comprising the Lyocell filaments is the layer which is in contact with the wearer.

In a woven fabric lining according to the invention, at least one of the warp and the weft is made from the same yarn throughout the layer of the fabric lining, i.e. a warp yarn or a weft yarn, which consists of or contains Lyocell filaments of having a linear density between 0.6 and 4 dtex, preferably between 0.8 and 1.7 dtex, in particular between 0.8 and 1.5 dtex.

One of the warp yarn and the weft yarn may comprise or consist of Lyocell filaments which have a smaller linear density than the respective other one of the warp yarn and weave yarn. Preferably, the weft yarn comprises or consists of Lyocell filaments having a smaller linear density than the Lyocell filaments of the warp yarn. The average linear density is preferably determined over all Lyocell filaments in the yarn.

Preliminary tests indicate that the usage of ring yarn made of Lyocell fibers may lead to even lower washing shrinkage.

According to another embodiment, the yarn, preferably each yarn in the at least one layer of the lining fabric, may contain or consist of between 30 and 100, preferably between 50 and 70 Lyocell filaments. The linear density of the yarn may be between 30 and 200 dtex, preferably between 50 and 150 dtex.

Strength is another quality criterion for a fabric lining. A lining fabric having high strength or high tenacity does not tear easily. It is thus preferred, according to another embodiment, that the Lyocell filaments in the conditioned state have an average dry tenacity of at least 32 cN/tex, preferably at least 38 cN/tex. An upper limit for the average dry tenacity may be 45 cN/tex, preferably 40 cN/tex. The average dry tenacity is preferably determined over all filaments in the yarn.

To have sufficient durability of the lining fabric according to the invention, it is further preferred that, in the conditioned state, the average dry elongation at break of the Lyocell filaments of the yarn is at least 6%. The average dry elongation at break in the conditioned state may be in the range between 6% and 8%. The average dry elongation is preferably determined using all filaments in a yarn.

The lining fabric may be dyed, in particular jet-dyed or cold pad dyed.

The fabric may further comprise a resin finish for preventing fibrillation.

The invention further relates to a clothing article, in particular, an outerwear clothing article having a lining made from a lining fabric in the one of the above-described embodiments. The clothing article may in particular be a dress-, shirt-, jacket-, coat- or cloak-like clothing article. The invention also relates to the use of a yarn consisting of or containing Lyocell filaments having an average linear density between 0.6 and 4 dtex, preferably between 0.8 and 1.7 dtex, more preferably between 0.8 and 1.5 dtex in a lining fabric for a clothing article.

The at least one layer of the lining fabric according to the invention is preferably made exclusively from Lyocell.

Next, embodiments of the invention are described in further detail with reference to the accompanying drawings and two test samples. In the drawings, the same reference numerals are used for elements that correspond to each other with respect to function and/or design.

It is further understood, that the various characteristics of the embodiments described below can be combined independently of one another as described above. For example, a feature can be omitted from an embodiment if the technical effect related to this feature is not needed in a particular application. Vice versa, a feature may be added to an embodiment if the technical effect associated with this particular feature is needed for a specific application.

Figure 1:
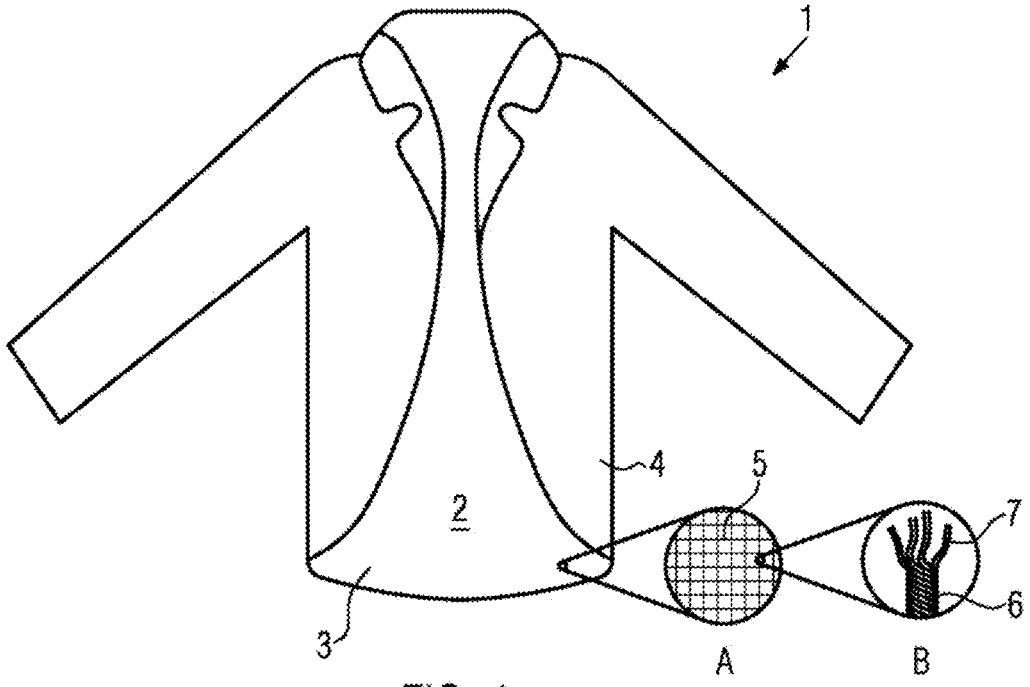
FIG. 1 shows a schematic drawing of a clothing article having a fabric lining according to the invention.

FIG. 1 shows a clothing article 1, e.g. a piece of outerwear, which may be dress-, shirt-, jacket-, coat- or cloak-like. An inner side 2 of the clothing article 1 faces a body (not shown) of a person wearing the clothing article 1. At its inner side, the clothing article 1 is provided with a lining fabric 3 which preferably forms a separate layer from the outer layer 4 of the clothing article 1. The lining fabric 3 may itself comprise several layers.

The lining fabric 3 may be dyed e.g. by jet dyeing or cold pad dyeing.

The lining fabric 3 may be woven as shown schematically in detail A. The woven fabric 5 is woven preferably exclusively from yarn 6 which contains, preferably consists of, Lyocell filaments 7.

Each yarn 6 contains, preferably consists of, between 30 and 100 Lyocell filaments, in particular between 50 and 70 Lyocell filaments.

In the conditioned state, the Lyocell filaments 7 preferably have an average dry tenacity of at least 30 cN/tex, preferably at least 38 cN/tex. The average linear density of the filaments 7 in the yarn 6 is between 0.6 and 4 dtex, preferably between 0.8 and 1.7 dtex and most preferred between 0.8 and 1.5 dtex.

In the conditioned state, the average dry elongation at break of the filaments is at least 6%, preferably between 6% and 8%. As the yarn is made from Lyocell filaments and not from staple fibers, the lining fabric is smooth. The hygroscopic characteristics of Lyocell ensure a comfortable wearing sensation.

The usage of lining fabric made from Lyocell filaments has the further advantage that the lining fabric is dimensionally stable even if washed in a regular household laundry machine.

Figure 2:
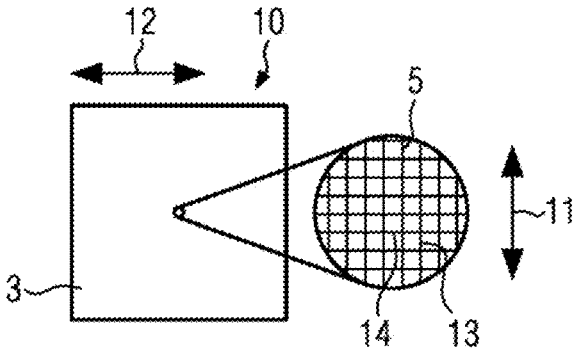
FIG. 2 shows a schematic view on a test sample of fabric lining according to the invention.

In particular, the washing shrinkage of the lining fabric 3 is determined on a sample 10 of lining fabric 3 as shown in FIG. 2. The sample 10 is prepared according to standard EN ISO 3759, the principal directions 11, 12 being perpendicular to each other and being aligned with the direction of the warp 13 and the weft 14, respectively. Washing shrinkage is determined on the sample 10, the washing conforming to standard EN ISO 6330. The washing shrinkage in any one of the two perpendicular directions after one washing is preferably not more than 2%, and/or after five washings not more than 3.5% in at least one of, preferably both, the perpendicular directions.

A combined washing shrinkage may be determined by adding the absolute value of the shrinkage in each of the two perpendicular directions. The combined shrinkage after one washing is preferably not more than 10%, more preferably not more than 7% after five washings. With the lining fabric according to the invention, even a combined washing shrinkage of no more than 3% can be attained after five washings. The combined washing shrinkage after one washing may be not more than 3%, preferably not more than 2%.

The yarn 6 used for the weft 12 may have a lower linear density than the yarn 6 used for the warp 12. In particular, the average linear density of the weft yarn may be less than 1.2 dtex.

The lining fabric 3 may be provided with a resin finish.

First Embodiment

According to a first embodiment, a filament Lyocell woven fabric suitable for use as a lining fabric, having a plain weave of 70 gsm, was processed on a jig-dyeing machine.

The fabric was pre-scoured for 30 minutes at 70° C. in a bath that contained 2 g/l anionic detergent and 2 g/l sodium carbonate.

Then, the fabric was rinsed in warm water to clear the chemicals and dyed afterwards.

The dye bath was set at 60° C. with 50 g/l sodium sulphate. After 5 minutes of running, 6% owg Remazol Navy RGB (vinyl sulphone reactive dye) was added portionwise over 15 minutes.

After continuing to run the fabric end to end for 15 minutes, 18 g/l sodium carbonate was metered into the dye bath for over 30 minutes. The dyeing continued for 30 minutes further to allow time for the dyes to fix. The dye bath was then drained and the fabric was washed in six baths as follows: (1) warm water at 50° C., (2) neutralization at 70° C. for 10 minutes in 1 cc/l acetic acid (70%), (3) water at 80° C., (4) boiling for 10 minutes at 95° C. with anionic detergent, (5) water at 80° C., and (6) cold water.

The washing was then completed by treatment for 15 minutes at 95° C. in 1 g/l anionic detergent and further rinsed until the washing liquors were clear.

The fabric was then removed from the jig-dyeing machine and the fabric dried on a stenter frame at 110° C. after being passed over a suction slot to remove excess water.

After drying, the fabric was resonated as follows:

Pad at 75% wet pick up in:

45 g/l Fixapret ECO (DMDHEU resin from BASF)

20 g/l Siligen VN (softener)

14 g/l Siligen SIN (softener)

15 g/l magnesium chloride
1 g/l acetic acid
1 g/l Kieralon Jet B conc (wetting agent)
Pad at 70-80% pick up:
Drying at 120° C. followed by curing at 170° C. for 3 minutes on a stenter frame.

The application of a resin prevented fibrillation from occurring in laundering.

The navy lining fabric was suitable as a washable jacket lining.

Second Embodiment

In a second embodiment, a Lyocell filament woven fabric suitable for use as a lining, again a plain weave of 70 gsm, was processed on a jig dyeing machine.

The fabric was pre-scoured for 30 minutes at 70° C. in a bath that contains 2 g/l anionic detergent and 2 g/l sodium carbonate. The fabric was then rinsed in warm water to clear the chemicals. The fabric was then dyed using a dye bath set at 60° C. with 50 g/l sodium sulphate. After 5 minutes running, 8% owg Remazol Midnight Black RGB (bi-reactive vinyl sulphone dye) was added portionwise over 15 minutes.

After continuing to run the fabric end to end for 15 minutes, 20 g/l sodium carbonate was metered into the dye bath for over 30 minutes. The dyeing continued for a further 40 minutes to allow time for the dye to fix. The dye bath was then drained and the fabric was washed in six baths as follows: (1) warm water at 50° C., (2) neutralization at 70° C. for 10 minutes in 1 cc/l acetic acid (70%), (3) water at 80° C., (4) boiling for 10 minutes at 95° C. with anionic detergent, (5) water at 80° C., and (6) cold water. The washing was then completed by treatment for 15 minutes at 95° C. in 1 g/l anionic detergent and further rinsing was carried out until the washing liquors were clear.

The fabric was then removed from the jig dyeing machine and dried on a stenter frame at 110° C. after being passed over a suction slot to remove excess water.

The black fabric was suitable for domestic laundering without fibrillation occurring.

Examples

The following examples demonstrate the superior properties of the Lyocell lining fabric according to the invention over lining fabric made from acetate, viscose and cupro filaments.

Examples 1 to 3 in Table 1 show the properties of a Lyocell lining fabric according to the invention; comparative examples 1 to 5 in Table 2 show the properties of a lining fabric made of acetate, viscose, and cupro filaments.

The yarn of which the fabric lining according to Examples 1 to 3 was generated as follows:

The sample 1, 2 and 3 were produced to obtain a lining woven material in the range of 80-95 g/m$^2$. The configuration, material and properties of sample 1 to 3 were summarized in table 1 (weight, density, weave, yarnconstruction).

Pulp (cellulose) was impregnated with a 78% watery N-methyl-morpholine-N-oxide (NMMO) solution, with and stabilizers and additives. The resulting suspension contained 11.6% cellulose, 68% NMMO, 20.4% water and stabilizer GPE. The pulp consisted of a mixture of sulfite and sulfate cellulose.

Excess water was evaporated from the resulting slurry under shear, vacuum and heating, to obtain a fiber-free spinning solution. The spinning solution contained 13% cellulose and 75.3% NMMO, the rest being water.

The spinning solution was filtered and extruded at 114° C. in a dry-wet process, wherein the spinning solution was extruded through nozzles into an air gap. For stabilizing the extrusion process, the air gap was provided with an air stream.

After crossing the air gap, the cellulose precipitated in a spinning bath containing 10% NMMO, the rest being water.

The endless filaments thus obtained were washed with water, impregnated with finish, dried and winded to a bobbin. A multi-filament consisting of single filaments was generated. From the multi-filaments, untwisted filament yarn was manufactured. From the filament yarns, the fabric lining according to the invention was woven. The linear density of the yarn was between 20 and 200 dtex, preferably between 50 and 150 dtex.

For other details of the manufacturing process, reference is made to U.S. Pat. No. 4,246,221, WO 02/18682 A1 and WO 02/72929 A1.

The fabric lining was washed as specified in EN ISO 6330 using Fewa Renew 3D Color Effect, manufactured by Henkel AG & Co. KGaA, as a detergent and unsoftened washing water at 40° C. After each washing, drum drying was used. Shrinking was determined after conditioning to an atmosphere having 65% humidity at 20° C. using a sample prepared according to EN ISO 3759.

The lining fabrics according to comparative examples 4 to 9 were obtained from commercially available woven fabrics. They were washed, dried and conditioned in the same manner as the examples 1 to 3.

It can be seen that the lining fabric according to the invention which was made from Lyocell yarn has superior dimensional stability as compared to the lining fabric after one and five washings.

It further can be seen that the linear density of the Lyocell filaments in Examples 1 to 3 is lower than for the comparative examples 1 to 5.

TABLE 1

| | Examples | | |
|---|---|---|---|
| | Example 1 | Example 2 | Example 3 |
| material analysis warp | Lyocell filaments bright single filament count: 1.36 dtex | Lyocell filaments bright Single filament count: 1.41 dtex | Lyocell filaments bright Single filament count: 1.24 dtex |
| material analysis weft | Lyocell filaments Single filament count: 1.35, dtex same as warp | Lyocell filaments Single filament count: 1.41 dtex same as warp | Lyocell filaments Single filament count: 1.26 dtex same as warp |
| finishing route | desized, fibrillation, cold pad dye, after treatment, finished product | desized, cold pad dye | desized, fibrillation, cold pad dye, after treatment, finished product |

TABLE 1-continued

| | Examples | | |
|---|---|---|---|
| | Example 1 | Example 2 | Example 3 |
| Weight (g/m$^2$) | 81 | 91 | 95 |
| Density warp (ends/dm) | 598 | 700 | 735 |
| Density weft (ends/dm) | 386 | 388 | 390 |
| weave | plain | cavalry | cavalry |
| Yarn count warp (dtex) | 78 | 81 | 82 |
| Yarn count weft (dtex) | 82 | 82 | 83 |
| Number of filaments warp | 60 | 60 | 60 |
| Number of filaments weft | 60 | 60 | 60 |
| washing shrinkage warp direction % | | | |
| after 1st wash | −1 | −1.7 | 1 |
| after 5th wash | −2.3 | −3 | −0.7 |
| washing shrinkage weft direction % | | | |
| after 1st wash | 0 | 1 | 1 |
| after 5th wash | −1 | 1.3 | 2.3 |
| combined washing shrinkage % | | | |
| after 1st wash | 1 | 2.7 | 2 |
| after 5th wash | 3.3 | 4.3 | 3 |

TABLE 2

| | Comparative Examples | | | | |
|---|---|---|---|---|---|
| | Comparative Example 1 | Comparative Example 2 | Comparative Example 3 | Comparative Example 4 | Comparative Example 5 |
| material and weaving pattern | 100% Acetate Pongé | 100% Viscose Taft | 100% Cupro Taft | 100% Viscose Satin | 100% Viscose Taft |
| material analysis warp | 100% Acetate fiber bright single filament count: 3.59 dtex | 100% Viscose bright single filament count: 3.01 dtex | 100% Cupro bright Single filament count: 1.62 dtex | 100% Viscose bright Single filament count: 2.57 dtex | 100% Viscose bright single filament count: 2.83 dtex |
| material analysis weft | 100% Acetate fiber bright single filament count: 4.17 dtex | 100% Viscose bright single filament count: 2.88 dtex | 100% Cupro bright single filament count: 1.40 dtex | 100% Viscose bright single filament count: 2.91 dtex effect yarn: 100% Viscose bright single filament count: 2.70 dtex | 100% Viscose bright single filament count: 2.96 dtex |
| weight g/m$^2$ | 60 | 71 | 55 | 108 | 69 |
| Density warp (ends/dm) | 408 | 450 | 478 | 758 | 460 |
| Density weft (ends/dm) | 264 | 298 | 364 | 278 | 274 |
| yarn count - warp dtex | 73 | 79 | 73 | 87 | 78 |
| yarn count - weft dtex | 108 | 124 | 70 | 145 | 123 |
| weave | plain | plain | plain | Satin | plain |
| Number of filaments warp | 20 | 24 | 36 | 30 | 30 |
| Number of filaments weft | 25 | 38 | 43 | 44 | 38 |
| washing shrinkage warp direction % | | | | | |
| After 1st wash | 0 | −6 | −3.6 | −4.6 | −6 |
| after 5th wash | −3.7 | −10 | −2.9 | −5.9 | −7.7 |
| washing shrinkage weft direction % | | | | | |
| after 1st wash | −3.3 | −6 | −3.3 | −3.9 | −3 |
| after 5th wash | −5.6 | −8.3 | −2.3 | −3.6 | −2.3 |

TABLE 2-continued

| | Comparative Examples | | | | |
|---|---|---|---|---|---|
| | Comparative Example 1 | Comparative Example 2 | Comparative Example 3 | Comparative Example 4 | Comparative Example 5 |
| combined washing shrinkage % | | | | | |
| after 1st wash | 3.3 | 12 | 6.9 | 8.5 | 9 |
| after 5th wash | 9.3 | 18.3 | 5.2 | 9.5 | 10 |

REFERENCE NUMERALS

1 clothing article
2 inner side
3 lining fabric
4 outer layer
5 woven fabric
6 yarn
7 Lyocell filaments
10 sample
11, 12 perpendicular directions of sample
13 warp
14 weft

The invention claimed is:

1. A lining fabric having at least one layer consisting of yarn, the yarn consisting of Lyocell filaments, wherein, in the conditioned state, the average linear density of the Lyocell filaments in the yarn is between 0.6 and 4 dtex, and wherein the lining fabric has a combined washing shrinkage after five washings of not more than 10%.

2. The lining fabric according to claim 1, wherein each yarn has a linear density between 30 and 200 dtex.

3. The lining fabric according to claim 2, wherein each yarn the washing shrinkage after five washings in one direction is not more than 3.5%.

4. The lining fabric according to claim 1, wherein, in the conditioned state, the average dry tenacity of the Lyocell filaments is at least 30 cN/tex.

5. The lining fabric according to claim 1, wherein, in the conditioned state, the average dry elongation at break of the filaments is at least 6%.

6. The lining fabric according to claim 1, wherein the lining fabric is dyed.

7. The lining fabric according to claim 6, wherein the dye is a reactive dye.

8. The lining fabric according claim 1, wherein the yarn comprises a resin finish.

9. The lining fabric according to claim 1, wherein the at least one layer of the lining fabric is woven and consists of or contains a weft yarn and a warp yarn as the yarn.

10. The lining fabric according to claim 9, wherein the weft yarn is made of Lyocell filaments having a lower average linear density than the Lyocell filaments in the warp yarn.

11. The lining fabric according to claim 9, wherein at least one of the warp yarn and the weft yarn is a ring yarn.

12. A clothing article having an inner side made of a lining fabric according to claim 1.

13. A method of making a lining fabric of a clothing article, the method comprising producing the lining fabric of claim 1.

14. A lining fabric having at least one layer consisting of yarn, the yarn consisting of Lyocell filaments, wherein, in a conditioned state, an average linear density of the Lyocell filaments in the yarn is between 0.8 and 1.5 dtex, and wherein the lining fabric has a combined washing shrinkage after five washings of not more than 10%.

15. A lining fabric having at least one layer consisting of yarn, the yarn consisting of Lyocell filaments, wherein, in a conditioned state, an average linear density of the Lyocell filaments in the yarn is between 0.8 and 1.5 dtex, and wherein the lining fabric has a combined washing shrinkage after fiver washings of not more than 10%, and wherein, in the conditioned state, an average dry tenacity of the Lyocell filaments is 37 cN/tex to 40 cN/tex.

* * * * *